US010964200B2

(12) United States Patent
Xue et al.

(10) Patent No.: US 10,964,200 B2
(45) **Date of Patent: *Mar. 30, 2021**

(54) ANTI-THEFT METHOD AND APPARATUS

(71) Applicant: Huawei Technologies Co., Ltd., Shenzhen (CN)

(72) Inventors: Kai Xue, Shanghai (CN); Nan Yang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/859,378

(22) Filed: Apr. 27, 2020

(65) Prior Publication Data

US 2020/0320852 A1 Oct. 8, 2020

Related U.S. Application Data

(63) Continuation of application No. 16/418,137, filed on May 21, 2019, which is a continuation of application No. 15/528,039, filed as application No. PCT/CN2014/094328 on Dec. 19, 2014, now Pat. No. 10,319,215.

(51) Int. Cl.

| | |
|---|---|
| ***G08B 25/10*** | (2006.01) |
| ***G08B 13/00*** | (2006.01) |
| ***G08B 13/196*** | (2006.01) |
| *G08B 21/22* | (2006.01) |

(52) U.S. Cl.

CPC ..... *G08B 25/10* (2013.01); *G08B 13/00* (2013.01); *G08B 13/19615* (2013.01); *G08B 13/19697* (2013.01); *G08B 21/22* (2013.01)

(58) Field of Classification Search

CPC ... G08B 25/10; G08B 13/00; G08B 13/19615

See application file for complete search history.

(56) References Cited

U.S. PATENT DOCUMENTS

| | | | |
|---|---|---|---|
| 2003/0084678 | A1 | 5/2003 | Kim |
| 2005/0213553 | A1 | 9/2005 | Wang et al. |
| 2007/0296576 | A1 | 12/2007 | Holowick |
| 2009/0005043 | A1 | 1/2009 | Claussen et al. |
| 2010/0097214 | A1 | 4/2010 | Sweeney et al. |

(Continued)

FOREIGN PATENT DOCUMENTS

| | | |
|---|---|---|
| CN | 1612176 A | 5/2005 |
| CN | 1934597 A | 3/2007 |

(Continued)

OTHER PUBLICATIONS

Machine Translation and Abstract of Japanese Publication No. JP2005151200, Jun. 9, 2005, 15 pages.

Machine Translation and Abstract of Chinese Publication No. CN101436336, May 20, 2009, 16 pages.

Machine Translation and Abstract of Chinese Publication No. CN201638329, Nov. 17, 2010, 7 pages.

(Continued)

*Primary Examiner* — Curtis B Odom

(74) *Attorney, Agent, or Firm* — Conley Rose, P.C.

(57) ABSTRACT

An alarm method and system reduces costs, and the alarm method includes obtaining a detection signal from a terminal device, where the detection signal is a signal sent by the terminal device when the terminal device detects whether there is an available network, and performing an alarm operation when the detection signal meets a first condition.

20 Claims, 2 Drawing Sheets

(56) References Cited

U.S. PATENT DOCUMENTS

| | | | | |
|---|---|---|---|---|
| 2013/0287011 | A1* | 10/2013 | Zhao | H04W 4/21 370/338 |
| 2014/0165640 | A1 | 6/2014 | Takeuchi et al. | |
| 2019/0272734 | A1 | 9/2019 | Xue et al. | |

FOREIGN PATENT DOCUMENTS

| | | | |
|---|---|---|---|
| CN | 101242202 | A | 8/2008 |
| CN | 101436336 | A | 5/2009 |
| CN | 201638329 | U | 11/2010 |
| CN | 101977375 | A | 2/2011 |
| CN | 102014459 | A | 4/2011 |
| CN | 102137395 | A | 7/2011 |
| CN | 102637331 | A | 8/2012 |
| CN | 102769710 | A | 11/2012 |
| CN | 102855718 | A | 1/2013 |
| CN | 102883320 | A | 1/2013 |
| CN | 102984459 | A | 3/2013 |
| CN | 103198632 | A | 7/2013 |
| CN | 103442097 | A | 12/2013 |
| CN | 103825808 | A | 5/2014 |
| CN | 203608365 | U | 5/2014 |
| CN | 103987130 | A | 8/2014 |
| CN | 104143240 | A | 11/2014 |
| CN | 105917395 | A | 8/2016 |
| EP | 2071250 | A1 | 6/2009 |
| EP | 2930440 | A1 | 10/2015 |
| GB | 2496196 | A | 5/2013 |
| JP | 2005151200 | A | 6/2005 |
| JP | 4819721 | B2 | 11/2011 |
| WO | 2009111996 | A1 | 9/2009 |
| WO | 2015164679 | A1 | 10/2015 |

OTHER PUBLICATIONS

Machine Translation and Abstract of Chinese Publication No. CN101977375, Feb. 16, 2011, 7 pages.
Machine Translation and Abstract of Chinese Publication No. CN102014459, Apr. 13, 2011, 18 pages.
Machine Translation and Abstract of Chinese Publication No. CN102855718, Jan. 2, 2013, 10 pages.
Machine Translation and Abstract of Chinese Publication No. CN103198632, Jul. 10, 2013, 5 pages.
Machine Translation and Abstract of Chinese Publication No. CN203608365, May 21, 2014, 4 pages.
Machine Translation and Abstract of Chinese Publication No. CN103825808, May 28, 2014, 5 pages.
Machine Translation and Abstract of Chinese Publication No. CN104143240, Nov. 12, 2014, 10 pages.
Machine Translation and Abstract of Chinese Publication No. CN1612176, May 4, 2005, 6 pages.
Machine Translation and Abstract of Chinese Publication No. CN101436336, May 20, 2009, 18 pages.
Machine Translation and Abstract of Chinese Publication No. CN102137395, Jul. 27, 2011, 22 pages.
Machine Translation and Abstract of Chinese Publication No. CN102769710, Nov. 7, 2012, 7 pages.
Machine Translation and Abstract of Chinese Publication No. CN102883320, Jan. 16, 2013, 10 pages.
Machine Translation and Abstract of Chinese Publication No. CN102984459, Mar. 20, 2013, 7 pages.
Machine Translation and Abstract of Chinese Publication No. CN1034.42097, Dec. 11, 2013, 13 pages.
Machine Translation and Abstract of Chinese Publication No. CN103987130, Aug. 13, 2014, 21 pages.
Zhao Shu Xu et al,"Internet of Things Technology", Nov. 1, 2012, ISBN:9787564320270, 1 page, with an English Abstract.

* cited by examiner

ANTI-THEFT METHOD AND APPARATUS

CROSS-REFERENCE TO RELATED APPLICATIONS

This application is a continuation of U.S. patent application Ser. No. 16/418,137, filed on May 21, 2019, which is a continuation of U.S. patent application Ser. No. 15/528,039, filed on May 18, 2017, now U.S. Pat. No. 10,319,215, which is a national stage of International Application No. PCT/CN2014/094328, filed on Dec. 19, 2014. All of the aforementioned applications are hereby incorporated by reference in their entireties.

TECHNICAL FIELD

The present disclosure relates to the field of anti-theft technologies, and in particular, to an anti-theft method and apparatus.

BACKGROUND

Common anti-theft systems for home use include an infrared alarm system based on infrared rays, a laser alarm system based on lasers, and the like. The infrared alarm system and the laser alarm system both need to be installed indoor and are relatively expensive, which increases costs.

SUMMARY

Embodiments of the present disclosure provide an anti-theft method and apparatus to reduce costs.

To achieve the foregoing objective, the following technical solutions are used in the embodiments of the present disclosure.

According to a first aspect, an anti-theft method is provided, including obtaining a detection signal from a terminal device, where the detection signal is a signal that is sent by the terminal device when the terminal device detects whether there is an available network and performing an alarm operation when the detection signal meets a preset condition.

With reference to the first aspect, in a first possible implementation manner, after the obtaining a detection signal from a terminal device, the method further includes obtaining a signal strength value of the detection signal, where that the detection signal meets a preset condition includes the signal strength value of the detection signal is greater than or equal to a preset value.

With reference to the first aspect, in a second possible implementation manner, after the obtaining a detection signal from a terminal device, the method further includes parsing the detection signal to obtain an identifier of the terminal device, where that the detection signal meets a preset condition includes the identifier of the terminal device is included in a preset identifier table.

With reference to the first aspect, in a third possible implementation manner, after the obtaining a detection signal from a terminal device, the method further includes obtaining a signal strength value of the detection signal, where the determining whether an identifier of the terminal device is included in a preset identifier table includes when the signal strength value of the detection signal is greater than or equal to a preset value, determining whether an identifier of the terminal device is included in a preset identifier table.

With reference to any one of the first aspect, or the first possible implementation manner to the third possible implementation manner of the first aspect, in a fourth possible implementation manner, the performing an alarm operation includes sending an alarm message to a preset terminal device, or sending an alarm indication message to an image collection apparatus, where the alarm indication message is used to instruct the image collection apparatus to collect an image of a user corresponding to the terminal device, or sending an alarm indication message to an alarm apparatus, where the alarm indication message is used to instruct the alarm apparatus to output an alarm message.

According to a second aspect, an anti-theft apparatus is provided, including an obtaining unit configured to obtain a detection signal from a terminal device, where the detection signal is a signal that is sent by the terminal device when the terminal device detects whether there is an available network, and an alarm unit configured to perform an alarm operation when the detection signal meets a preset condition.

With reference to the second aspect, in a first possible implementation manner, the obtaining unit is further configured to obtain a signal strength value of the detection signal, where that the detection signal meets a preset condition includes the signal strength value of the detection signal is greater than or equal to a preset value.

With reference to the second aspect, in a second possible implementation manner, the anti-theft apparatus further includes a parsing unit configured to parse the detection signal to obtain an identifier of the terminal device, where that the detection signal meets a preset condition includes the identifier of the terminal device is included in a preset identifier table.

With reference to the second aspect, in a third possible implementation manner, the obtaining unit is further configured to obtain a signal strength value of the detection signal, and the parsing unit is specifically configured to parse the detection signal to obtain an identifier of the terminal device, where that the detection signal meets a preset condition includes the signal strength value of the detection signal is greater than or equal to a preset value, and the identifier of the terminal device is included in a preset identifier table.

With reference to any one of the second aspect, or the first possible implementation manner to the third possible implementation manner of the second aspect, in a fourth possible implementation manner, the alarm unit is configured to send an alarm message to a preset terminal device, or send an alarm indication message to an image collection apparatus, where the alarm indication message is used to instruct the image collection apparatus to collect an image of a user corresponding to the terminal device, or send an alarm indication message to an alarm apparatus, where the alarm indication message is used to instruct the alarm apparatus to output an alarm message.

According to a third aspect, an anti-theft apparatus is provided, including a memory and a processor, and the memory is configured to store a group of code, and the code is configured to control the processor to execute the following actions obtaining a detection signal from a terminal device, where the detection signal is a signal that is sent by the terminal device when the terminal device detects whether there is an available network, and performing an alarm operation when the detection signal meets a preset condition.

With reference to the third aspect, in a first possible implementation manner, the processor is further configured to obtain a signal strength value of the detection signal, where that the detection signal meets a preset condition includes the signal strength value of the detection signal is greater than or equal to a preset value.

With reference to the third aspect, in a second possible implementation manner, the processor is further configured to parse the detection signal to obtain an identifier of the terminal device, where that the detection signal meets a preset condition includes the identifier of the terminal device is included in a preset identifier table.

With reference to the third aspect, in a third possible implementation manner, the processor is specifically configured to obtain a signal strength value of the detection signal, and parse the detection signal to obtain an identifier of the terminal device, where that the detection signal meets a preset condition includes the signal strength value of the detection signal is greater than or equal to a preset value, and the identifier of the terminal device is included in a preset identifier table.

With reference to any one of the third aspect, or the first possible implementation manner to the third possible implementation manner of the third aspect, in a fourth possible implementation manner, the processor is specifically configured to send an alarm message to a preset terminal device, or send an alarm indication message to an image collection apparatus, where the alarm indication message is used to instruct the image collection apparatus to collect an image of a user corresponding to the terminal device, or send an alarm indication message to an alarm apparatus, where the alarm indication message is used to instruct the alarm apparatus to output an alarm message.

According to the anti-theft method and apparatus that are provided in the embodiments of the present disclosure, a network device may obtain a detection signal from a terminal device, and implement anti-theft according to the detection signal. Compared with the other approaches, the anti-theft method provided in the embodiments of the present disclosure may be implemented using an existing network device (such as a router or a web television), and no new hardware needs to be installed, which can greatly reduce costs.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly and completely describes the technical solutions in the embodiments of the present disclosure with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

Currently, with popularity of smart terminal devices, almost everyone carries a terminal device having a Wi-Fi/BLUETOOTH function. After a Wi-Fi/BLUETOOTH function is enabled in the terminal device having a Wi-Fi/BLUETOOTH function, the terminal device may send a detection signal at any time. The detection signal is a signal sent by the terminal device when the terminal device detects whether there is an available network. When a network device obtains the detection signal, even if the terminal device has no permission to access a network of the network device, the network device still obtains information about the terminal device. The information includes a media access control (MAC) address of the terminal device, signal strength of a detection signal, and the like.

Embodiments of the present disclosure provide an anti-theft method and apparatus. During specific implementation, it is assumed that everyone carries a terminal device whose Wi-Fi/BLUETOOTH function is enabled, and that when there is an illegal intruder indoor, in most cases, the illegal intruder has no relationship with a family member.

The character "I" in this specification generally indicates an "or" relationship between the associated objects. In addition, the term "more" in this specification refers to two or more than two.

Embodiment 1

Figure 1:
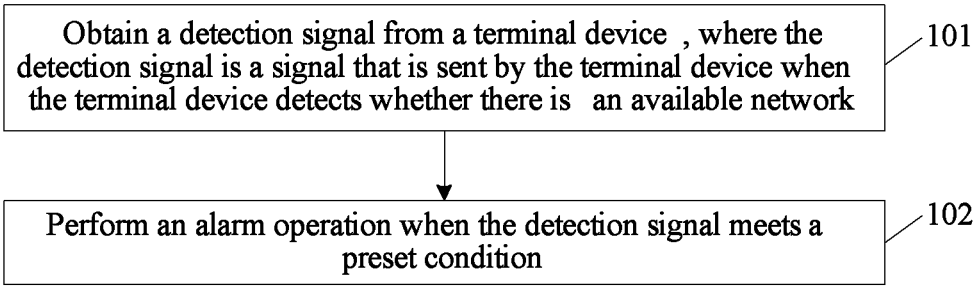
FIG. 1 is a flowchart of an anti-theft method according to Embodiment 1 of the present disclosure.

This embodiment of the present disclosure provides an anti-theft method, as shown in FIG. 1, includes the following steps.

101: Obtain a detection signal from a terminal device, where the detection signal is a signal that is sent by the terminal device when the terminal device detects whether there is an available network.

In this embodiment of the present disclosure, the method may be executed by a network device, and may be specifically a Wi-Fi network device, such as a router or a smart television, or may be specifically a BLUETOOTH network device, such as a smart television having a BLUETOOTH function. It should be noted that, these network devices have database functions, and can store and query information about a terminal device that interacts with the network devices. The anti-theft method provided in this embodiment of the present disclosure may be applied to household anti-theft, or may be applied to anti-theft in public places. This embodiment of the present disclosure is described using an example in which the method is applied to household anti-theft.

Specifically, "the detection signal" currently may be a Wi-Fi signal, a BLUETOOTH signal, or the like; and "the available network" may be a Wi-Fi network, a BLUETOOTH network, or the like.

In addition, before step 101, the method may further include starting an anti-theft system, where the anti-theft system is configured to implement the anti-theft method provided in this embodiment of the present disclosure. Specifically, a user of the network device may manually start the anti-theft system. For example, when a button for starting the anti-theft system is set on the network device, the user starts the anti-theft system using the button when he or she is leaving a house. The network device may automatically start the anti-theft system. For example, when the network device does not obtain the detection signal from the terminal device in a preset time segment, the network device automatically starts the anti-theft system. In addition, after leaving the house, the user may start the anti-theft system through remote control using his or her own terminal device.

102: Perform an alarm operation when the detection signal meets a preset condition.

Optionally, after step 101, the method may further include obtaining a signal strength value of the detection signal, where that the detection signal meets a preset condition includes the signal strength value of the detection signal is greater than or equal to a preset value.

It should be noted that, a closer distance between the terminal device and the network device indicates a larger signal strength value of the detection signal that is obtained by the network device from the terminal device, that is, stronger signal strength, and the signal strength of the detection signal attenuates in an order of magnitude when there is a wall or a door between the terminal device and the network device. That is, when doors and windows of a room are closed, signal strength of a detection signal obtained by the network device from the terminal device when the terminal device is in the room differs in an order of magnitude from signal strength of a detection signal obtained by the network device from the terminal device when the terminal device is outside the room. To reduce a false alarm rate of performing an alarm operation by the network device, the preset value may be set relatively appropriately by means of testing. For example, after the testing, signal strength of a Wi-Fi network that is 50 meters from a Wi-Fi router with no block is −90 decibel meters (dbm), and the signal strength ensures that the terminal device can use the Wi-Fi network for normal Wi-Fi communication. Signal strength of a Wi-Fi network that is 10 meters from the Wi-Fi router with no block is −70 dbm, and in this case, it may be considered that the terminal device and the Wi-Fi router are in a same room. Therefore, the preset value may be set to −70 dbm.

Certainly, the preset signal strength value of the detection signal may be set according to other conditions or specific cases, which is not limited in this embodiment of the present disclosure.

During specific implementation of the optional method, after obtaining the detection signal from the terminal device, the network device may directly determine the signal strength value of the detection signal.

Optionally, after step 101, the method may further include parsing the detection signal to obtain an identifier of the terminal device, where that the detection signal meets a preset condition includes the identifier of the terminal device is included in a preset identifier table.

Exemplarily, the identifier of the terminal device may be a media access control (MAC) address, a device identifier (Device ID), or the like of the terminal device.

Specifically, the preset identifier table may be a set including identifiers of one or more terminal devices. The set is obtained by the network device according to detection signals from the one or more terminal devices when the anti-theft system is not started, and stores the identifiers of the one or more terminal devices. In addition, the set may be manually set by the user and include the identifiers of the one or more terminal devices.

It should be noted that, in the anti-theft method provided in this embodiment of the present disclosure, the anti-theft system is started by default. After the anti-theft system is started, the network device obtains a detection signal sent by each terminal device, and obtains an identifier of the terminal device according to the detection signal, but does not store the identifier in the preset identifier table.

Specifically, during specific implementation of step 1), when the detection signal is a Wi-Fi detection signal, the network device may obtain the identifier of the terminal device according to a Wi-Fi protocol; and when the detection signal is a BLUETOOTH detection signal, the network device may obtain the identifier of the terminal device according to a BLUETOOTH protocol.

Optionally, to improve accuracy of the anti-theft method, after step 101, the method may further include obtaining a signal strength value of the detection signal, and parsing the detection signal to obtain an identifier of the terminal device, where that the detection signal meets a preset condition includes the signal strength value of the detection signal is greater than or equal to a preset value, and the identifier of the terminal device is included in a preset identifier table.

Specifically, that the detection signal meets a preset condition may be other cases, which is not limited in this embodiment of the present disclosure. For example, that the detection signal meets a preset condition may further include the signal strength value of the detection signal from the terminal device is greater than or equal to a preset value, and the terminal device has no permission to access a network device that executes the anti-theft method.

Optionally, during specific implementation of the performing an alarm operation, the following manners may be used.

Manner 1: Send an alarm message to a preset terminal device.

Manner 2: Send an alarm indication message to an image collection apparatus, where the alarm indication message is used to instruct the image collection apparatus to collect an image of a user corresponding to the terminal device.

Manner 3: Send an alarm indication message to an alarm apparatus, where the alarm indication message is used to instruct the alarm apparatus to output an alarm message.

During specific implementation of manner 1, there may be one or more preset terminal devices. Specifically, the preset terminal device may be a terminal device of the user of the network device, or may be a terminal device designated by the user of the network device.

During specific implementation of manner 2, the image collection apparatus may be a camera or a video camera. The image collection apparatus may be disposed in a room or outside a room, for example, at a door outside a room, or in a passageway outside a room.

During specific implementation of manner 3, the alarm apparatus may be specifically an alarm bell. Similarly, the alarm apparatus may be disposed in a room or outside a room.

During specific implementation of manner 2 and manner 3, the network device may send an alarm indication message to the image collection apparatus or the alarm apparatus through a network.

It should be noted that, the network device may perform the alarm operation in other manners. This embodiment of the present disclosure is merely exemplary description, and does not limit the manners.

According to the anti-theft method provided in this embodiment of the present disclosure, a network device may obtain a detection signal from a terminal device, and implement anti-theft according to the detection signal. Compared with the other approaches, the anti-theft method provided in this embodiment of the present disclosure may be implemented using an existing network device (such as a router or a web television), and no new hardware needs to be installed, which can greatly reduce costs.

Embodiment 2

Figure 2:
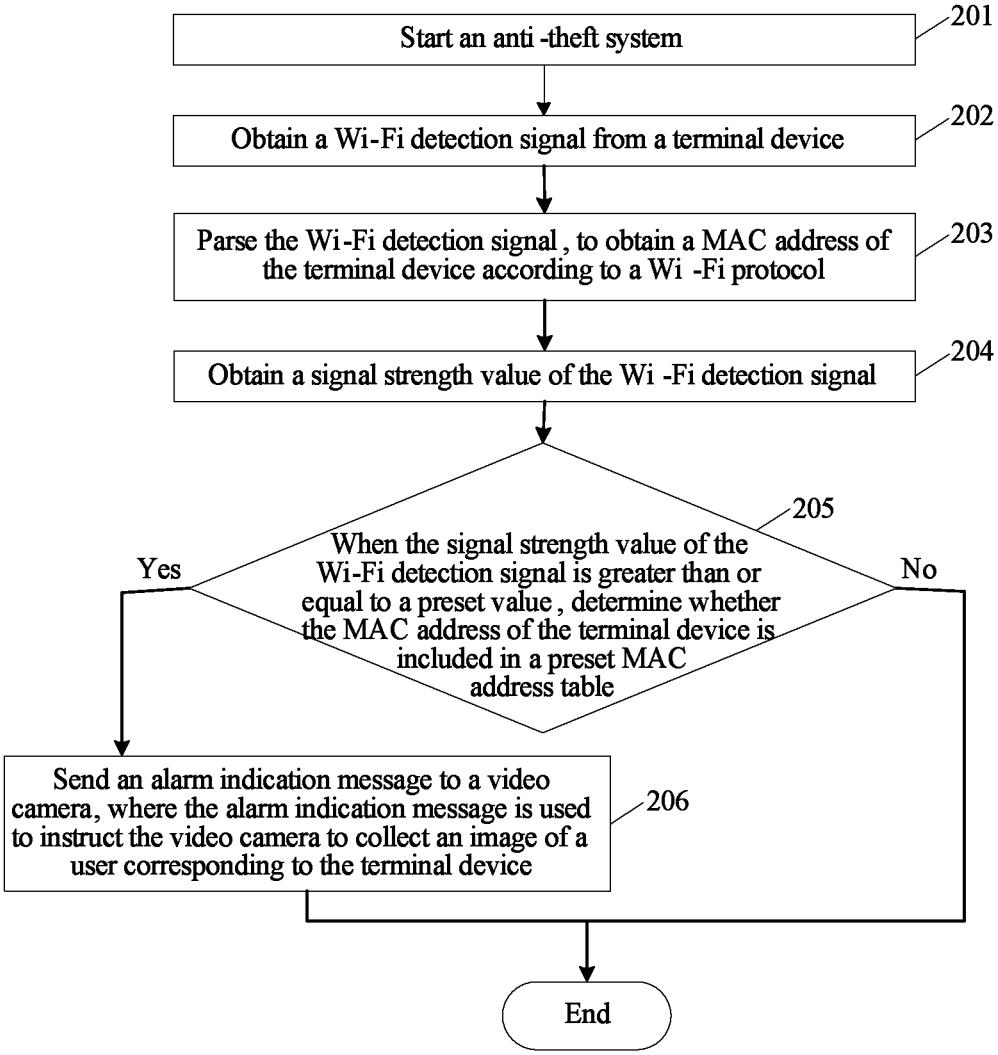
FIG. 2 is a flowchart of an anti-theft method according to Embodiment 2 of the present disclosure.

This embodiment exemplarily describes the anti-theft method provided in Embodiment 1. In this embodiment, the method is executed by a Wi-Fi router. For related explanations, refer to the foregoing embodiment. As shown in FIG. 2, the method may specifically include the following steps.

201: Start an anti-theft system.

During specific implementation of step 201, when a button for starting the anti-theft system is set on a network device, a user of the network device starts the anti-theft system using the button when he or she is leaving a house.

202: Obtain a Wi-Fi detection signal from a terminal device.

203: Parse the Wi-Fi detection signal to obtain a MAC address of the terminal device according to a Wi-Fi protocol.

It should be noted that, any device on a network has a MAC address, and the MAC address is generally factory set, and does not change.

204: Obtain a signal strength value of the Wi-Fi detection signal.

It should be noted that, there is no particular sequence between step 203 and step 204. That is, step 203 may be performed first and step 204 may be executed; or, step 204 may be performed first and step 203 may be executed; or, step 203 and step 204 may be simultaneously performed.

205: When the signal strength value of the Wi-Fi detection signal is greater than or equal to a preset value, determine whether the MAC address of the terminal device is included in a preset MAC address table.

If yes, step 206 is executed; or if not, the process ends.

206: Send an alarm indication message to a video camera, where the alarm indication message is used to instruct the video camera to collect an image of a user corresponding to the terminal device.

Specifically, the video camera may be disposed at a door, a window, or the like of a room.

According to the anti-theft method provided in this embodiment of the present disclosure, a network device may obtain a detection signal from a terminal device, and implement anti-theft according to the detection signal. Compared with the other approaches, the anti-theft method provided in this embodiment of the present disclosure may be implemented using an existing network device (such as a router or a web television), and no new hardware needs to be installed, which can greatly reduce costs.

Embodiment 3

Figure 3:
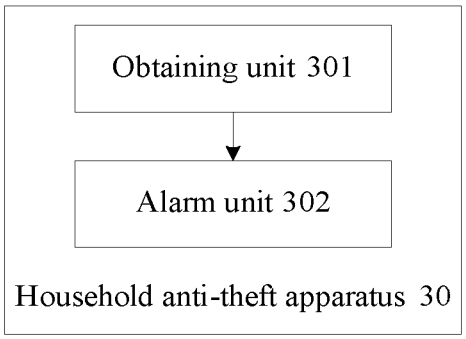
FIG. 3 is a schematic structural diagram of an anti-theft apparatus according to Embodiment 3 of the present disclosure.

This embodiment of the present disclosure provides an anti-theft apparatus 30 configured to execute the anti-theft method shown in FIG. 1. As shown in FIG. 3, the anti-theft apparatus 30 includes an obtaining unit 301 and an alarm unit 302.

The obtaining unit 301 is configured to obtain a detection signal from a terminal device, where the detection signal is a signal that is sent by the terminal device when the terminal device detects whether there is an available network.

The alarm unit 302 is configured to perform an alarm operation when the detection signal meets a preset condition.

Optionally, the obtaining unit 301 is further configured to obtain a signal strength value of the detection signal, where that the detection signal meets a preset condition includes the signal strength value of the detection signal is greater than or equal to a preset value.

Figure 4:
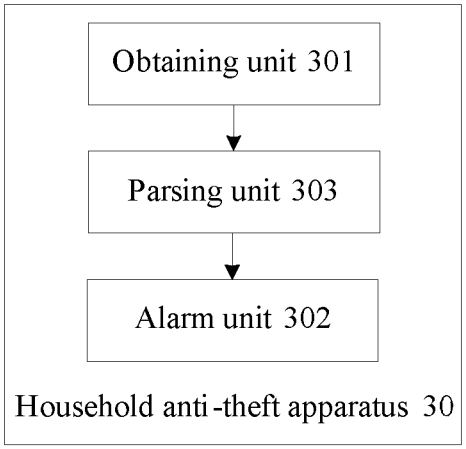
FIG. 4 is a schematic structural diagram of another anti-theft apparatus according to Embodiment 3 of the present disclosure.

Optionally, as shown in FIG. 4, the anti-theft apparatus 30 further includes a parsing unit 303 configured to parse the detection signal to obtain an identifier of the terminal device, where that the detection signal meets a preset condition includes the identifier of the terminal device is included in a preset identifier table.

Optionally, the obtaining unit 301 is further configured to obtain a signal strength value of the detection signal; and the parsing unit 303 is further configured to parse the detection signal to obtain an identifier of the terminal device, where that the detection signal meets a preset condition includes the signal strength value of the detection signal is greater than or equal to a preset value, and the identifier of the terminal device is included in a preset identifier table.

Optionally, the alarm unit 302 is configured to send an alarm message to a preset terminal device; or, send an alarm indication message to an image collection apparatus, where the alarm indication message is used to instruct the image collection apparatus to collect an image of a user corresponding to the terminal device; or, send an alarm indication message to an alarm apparatus, where the alarm indication message is used to instruct the alarm apparatus to output an alarm message.

According to the anti-theft apparatus provided in this embodiment of the present disclosure, a network device may obtain a detection signal from a terminal device, and implement anti-theft according to the detection signal. Compared with the other approaches, the anti-theft method provided in this embodiment of the present disclosure may be implemented using an existing network device (such as a router or a web television), and no new hardware needs to be installed, which can greatly reduce costs.

Embodiment 4

In hardware implementation, each unit in Embodiment 3 may be embedded in or independent of a processor of the anti-theft apparatus in a hardware form, or may be stored in a memory of the anti-theft apparatus in a software form, so that a processor invokes and executes an operation corresponding to the unit, where the processor may be a central processing unit (CPU), a microprocessor, a single-chip microcomputer, or the like.

Figure 5:
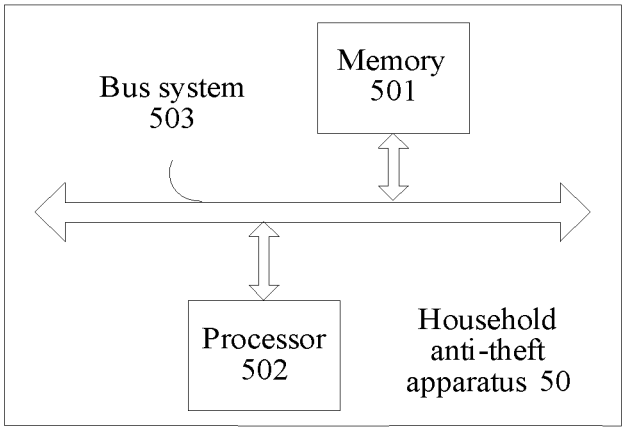
FIG. 5 is a schematic structural diagram of an anti-theft apparatus according to Embodiment 4 of the present disclosure.

FIG. 5 shows an anti-theft apparatus 50 provided in this embodiment of the present disclosure configured to execute the anti-theft method shown in FIG. 1. The anti-theft apparatus 50 includes a memory 501, a processor 502, and a bus system 503.

The memory 501 and the processor 502 are coupled with each other through the bus system 503. In addition to a data bus, the bus system 503 may further include a power bus, a control bus, a status signal bus, and the like. However, for the purpose of clear description, various buses in the figure are all marked as the bus system 503.

The memory 501 is configured to store a group of code.

The code stored in the memory 501 is configured to control the processor 502 to execute the following actions obtaining a detection signal from a terminal device, where the detection signal is a signal sent by the terminal device when the terminal device detects whether there is an available network; and performing an alarm operation when the detection signal meets a preset condition.

Optionally, the processor 502 is further configured to obtain a signal strength value of the detection signal, where that the detection signal meets a preset condition includes the signal strength value of the detection signal is greater than or equal to a preset value.

Optionally, the processor 502 is further configured to parse the detection signal to obtain an identifier of the terminal device, where that the detection signal meets a preset condition includes the identifier of the terminal device is included in a preset identifier table.

Optionally, the processor 502 is further configured to obtain a signal strength value of the detection signal; and parse the detection signal to obtain an identifier of the terminal device, where that the detection signal meets a preset condition includes the signal strength value of the detection signal is greater than or equal to a preset value, and the identifier of the terminal device is included in a preset identifier table.

Optionally, the processor 502 is configured to send an alarm message to a preset terminal device; or, the processor 502 is configured to send an alarm indication message to an image collection apparatus, where the alarm indication message is used to instruct the image collection apparatus to collect an image of a user corresponding to the terminal device; or, the processor 502 is configured to send an alarm indication message to an alarm apparatus, where the alarm indication message is used to instruct the alarm apparatus to output an alarm message.

According to the anti-theft apparatus provided in this embodiment of the present disclosure, a network device may obtain a detection signal from a terminal device, and implement anti-theft according to the detection signal. Compared with the other approaches, the anti-theft method provided in this embodiment of the present disclosure may be implemented using an existing network device (such as a router or a web television), and no new hardware needs to be installed, which can greatly reduce costs.

In the several embodiments provided in this application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in a form of hardware, or may be implemented in a form of hardware in addition to a software functional unit.

When the foregoing integrated unit is implemented in a form of a software functional unit, the integrated unit may be stored in a computer-readable storage medium. The software functional unit is stored in a storage medium and includes several instructions for instructing a computer device (which may be a personal computer, a server, or a network device) to perform some of the steps of the methods described in the embodiments of the present disclosure. The foregoing storage medium includes any medium that can store program code, such as a universal serial bus (USB) flash drive, a removable hard disk, a read-only memory (ROM), a random access memory (RAM), a magnetic disk, or an optical disc.

Finally, it should be noted that the foregoing embodiments are merely intended for describing the technical solutions of the present disclosure but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present disclosure.

The invention claimed is:

1. A network device, comprising:

at least one processor; and a memory coupled to the at least one processor and configured to store instructions that, when executed by the at least one processor, cause the network device to:

determine whether a first detection signal from a first device is detected, wherein the first device is associated with the network device;

automatically start an alarm function when the network device does not detect the first detection signal within a time segment;

obtain a second detection signal from a second device; and send an alarm message to the first device based on the second detection signal.

2. The network device of claim 1, wherein the instructions further cause the network device to send an alarm indication message to an image collection apparatus, wherein the alarm indication message instructs the image collection apparatus to collect an image.

3. The network device of claim 1, wherein the instructions further cause the network device to send an alarm indication message to an alarm apparatus, wherein the alarm indication message instructs the alarm apparatus to output an alarm.

4. The network device of claim 1, wherein the instructions further cause the network device to send the alarm message to the first device when the second detection signal meets a first condition, and wherein the first condition comprises a signal strength value of the second detection signal being greater than or equal to a first threshold.

5. The network device of claim 4, wherein the first condition further comprises an identifier of the second device not being included in a first identifier table.

6. The network device of claim 1, wherein the network device is a router.

7. The network device of claim 3, wherein the alarm apparatus is an alarm bell.

8. An alarm method implemented by a network device, comprising:

determining that a first device is not detectable, wherein the first device is associated with the network device;

automatically starting an alarm function in response to the first device not being detectable;

obtaining a detection signal from a second device; and sending an alarm message to the first device in response to the detection signal meeting a first condition.

9. The alarm method of claim 8, further comprising sending an alarm indication message to an alarm apparatus, wherein the alarm indication message instructs the alarm apparatus to output an alarm.

10. The alarm method of claim 8, further comprising sending an alarm indication message to an image collection system, wherein the alarm indication message instructs the image collection system to collect an image.

11. The alarm method of claim 8, wherein the first condition comprises a signal strength value of the detection signal being greater than or equal to a first threshold and an identifier of the second device not being included in a first identifier table.

12. The alarm method of claim 8, further comprising determining that the first device is not detectable when a second detection signal from the first device is not detected within a time segment.

13. A computer program product comprising computer-executable instructions for storage on a non-transitory computer-readable medium that, when executed, cause a system to:

determine that a first device is not detectable, wherein the first device is associated with the system;

automatically start an alarm function in response to the first device not being detectable;

obtain a detection signal from a second device; and send an alarm message to the first device based on the second detection signal.

14. The computer program product of claim 13, wherein the computer-executable instructions further cause the system to send an alarm indication message to an alarm apparatus, and wherein the alarm indication message instructs the alarm apparatus to output an alarm.

15. The computer program product of claim 13, wherein the computer-executable instructions further cause the system to send an alarm indication message to an image collection system, and wherein the alarm indication message instructs the image collection system to collect an image.

16. The computer program product of claim 13, wherein the detection signal comprises a WI-FI signal.

17. The computer program product of claim 13, wherein the computer-executable instructions further cause the system to send the alarm message to the first device when the second detection signal meets a first condition, wherein the first condition comprises a signal strength value of the detection signal being greater than or equal to a first threshold.

18. The computer program product of claim 17, wherein the first condition further comprises an identifier of the second device not being included in a first identifier table.

19. The computer program product of claim 13, wherein the system comprises a router.

20. The computer program product of claim 13, wherein the computer-executable instructions further cause the system to determine that that the first device is not detectable when the second detection signal from the first device is not detected within a time segment.

* * * * *